US005245980A

United States Patent [19]

Colvin

[11] Patent Number: 5,245,980

[45] Date of Patent: Sep. 21, 1993

[54] TORQUE ADJUSTABLE ARROW REST

[75] Inventor: Richard O. Colvin, Baldwinsville, N.Y.

[73] Assignee: Kinetronic Industries, Inc., Media, Pa.

[21] Appl. No.: 902,991

[22] Filed: Jun. 23, 1992

[51] Int. Cl.[5] ..... F41B 5/00

[52] U.S. Cl. ..... 124/24.1; 124/44.5

[58] Field of Search ..... 124/44.5, 24.1, 23.1, 124/41.1, 88

[56] References Cited

U.S. PATENT DOCUMENTS

| | | | |
|---|---|---|---|
| 2,998,811 | 9/1961 | Sackmann | 124/24 |
| 3,059,631 | 10/1962 | Yasho | 124/44.5 |
| 3,108,584 | 10/1963 | Coe | 124/24.1 |
| 3,865,096 | 2/1975 | Troncoso, Jr. | 124/24.1 |
| 3,890,951 | 6/1975 | Jennings et al. | 124/44.5 |
| 3,935,854 | 2/1976 | Troncoso, Jr. | 124/24.1 |
| 4,236,497 | 12/1980 | Troncoso, Jr. | 124/24.1 |
| 4,332,232 | 6/1982 | Troncoso, Jr. | 124/24.1 |
| 4,380,226 | 4/1983 | Saunders | 124/44.5 |
| 4,398,528 | 8/1983 | Troncoso, Jr. | 124/24.1 |
| 4,421,092 | 12/1983 | Christian | 124/44.5 |
| 4,476,846 | 10/1984 | Carville | 124/44.5 |
| 4,489,704 | 12/1984 | Troncoso, Jr. | 124/24.1 |
| 4,569,325 | 2/1986 | Christian | 124/44.5 |
| 4,598,688 | 7/1986 | Paul et al. | 124/44.5 |
| 4,664,093 | 5/1987 | Nunemaker | 124/24.1 |
| 4,686,956 | 8/1987 | Troncoso, Jr. | 124/44.5 |
| 4,703,745 | 11/1987 | Hammond | 124/44.5 |
| 4,715,355 | 12/1987 | Lattig | 124/44.5 |
| 4,748,964 | 6/1988 | Troncoso, Jr. | 124/44.5 |
| 4,756,295 | 7/1988 | Guzzetta | 124/16 |
| 4,809,670 | 3/1989 | Simo | 124/44.5 |
| 4,827,895 | 5/1989 | Troncoso, Jr. | 124/44.5 |
| 4,838,237 | 6/1989 | Cliburn | 124/44.5 |
| 4,865,007 | 9/1989 | Saunders | 124/44.5 |
| 4,890,596 | 1/1990 | Barlow | 124/44.5 |
| 4,947,823 | 8/1990 | Larson | 124/44.5 |
| 4,953,521 | 9/1990 | Troncoso et al. | 124/24.1 |
| 5,025,773 | 6/1991 | Hintze et al. | 124/24.1 |
| 5,031,601 | 7/1991 | Gunter | 124/44.5 |
| 5,052,364 | 10/1991 | Martin et al. | 124/44.5 |

OTHER PUBLICATIONS

"Cabela's", Oct. 1989, p. 131.

"Bow and Arrow", Jun. 1982, p. 41.

*Primary Examiner*—Randolph A. Reese

*Assistant Examiner*—Harry C. Kim

*Attorney, Agent, or Firm*—D. Peter Hochberg; Mark Kusner; Michael Jaffe

[57] ABSTRACT

An arrow rest for an archery bow is provided with two arrow support arms, each of which has a free end pivotal in an arc about a fixed end fastened to supporting structure mountable on a bow. Each of the arms is adjustably biased by an enclosed spring fastened on the structure adjacent to the arm, and is provided with an arc-limiting collar which limits the travel of the arm. One of the arms is adapted to pivot in a horizontal plane, the other in a vertical plane, such biased pivoting dampening temporary distortions imposed on the arrows as a result of bowstring forces generated during the process of the arrows' launch.

18 Claims, 4 Drawing Sheets

TORQUE ADJUSTABLE ARROW REST

TECHNICAL FIELD

This invention relates to improved archery equipment designed to provide more accurate and consistent shooting. More particularly, this invention relates to an arrow rest for an archery bow that dampens the temporary distortions or warping caused by bowstring-imposed forces experienced by arrows launched from a bow. Specifically, this invention relates to an arrow rest for an archery bow provided with two arms, pivotable at right angles to each other, that respectively provide vertical and horizontal dampening biases to arrows launched thereover by means of adjustable torque forces operative on the arms.

BACKGROUND OF THE INVENTION

Interest in the bow and its use has continued to grow over the years despite its obsolescence as a weapon of warfare, and notwithstanding the lessening importance of the bow as an implement relied upon to provide food for the archer. In this regard archery has evolved into a pastime for individuals, important objectives of which are to compete successfully with other individuals similarly interested, as well as to better the archer's own prior performance. With some archers, however, hunting continues to provide an incentive for developing a higher degree of shooting proficiency.

In any case, improvement in shooting accuracy, remains essential to the successful pursuit of the activity, as well as its enjoyment, and considerable effort is devoted by enthusiasts in continuing to develop archery skills, including the ability to correctly estimate windage and target distance, and in properly sighting and operating their bows.

In the past, enhancement of such personal physical skills was the primary way in which archers might hope to develop shooting proficiency. Increasingly, however, technology has become a factor of major importance in the attainment of superior shooting performance, and much effort has been devoted to its refinement. Such technology has, for example, resulted in the development of such things as peep sights, adjustable string knocks, mechanical release mechanisms, stabilizing arrow rests and cushion plungers, and other accessories too numerous to mention.

With respect to arrow rests, such devices are commonly attached to the handle of the bow where they function to provide vertical biasing for arrows placed on the rest during shooting. Temporary bending of the arrows in a vertical plane, due to forces imposed thereon by release of the bowstring during the act of launch, can thus be minimized, resulting in greater arrow stability and improved flight characteristics.

One such device, provided with adjustable biasing means, is described, for example, in co-pending U.S. application Ser. No. 524,219, U.S. Pat. No. 5,144,937. The arrow rest of the invention there disclosed includes means for adjusting the degree of biasing applied to the arrow, and therefore, provides means for varying the amount of dampening to correspond to shooting conditions, arrow-type and similar variables. However, the arrow rest taught desirably relies on an auxiliary device, i.e., a "cushion plunger", to support the arrow laterally, and to apply adjustable transverse biasing to dampen the temporary bending of the arrow in a horizontal plane.

Still another arrow test is that described in U.S. Pat. No. 4,398,528. The device disclosed in that patent consist of two flat blades extending from anchor points on the arrow rest structure fastened to the bow. The tips of the blades support an arrow placed on the arrow rest both vertically and laterally. In addition, the blades possess a spring-like resiliency which serves as a biasing means to dampen the temporary distortions experienced by arrows shot over the arrow rest. A significant disadvantage of the device, however, resides in the fact that, at best, it is difficult to finely adjust the biasing forces generated by the device to modify shooting characteristics, and to adjust such forces without also changing the position of the blade tips on which the arrows are disposed.

BRIEF DESCRIPTION OF THE INVENTION

In view of the foregoing therefore, it is a first object of this invention to provide an improved arrow rest for arrows.

A second object of this invention is to provide an arrow rest that furnishes both vertical and lateral support to arrows placed thereon.

An additional object of this invention is to furnish an arrow rest with vertical and horizontal arrow-biasing means, finely adjustable to provide variable biasing forces.

A further object of this invention is to provide an arrow rest with vertical and horizontal biasing means that can be adjusted without changing the position of the arrow rest support structure.

Another object of this invention is to provide an arrow rest with vertical and horizontal biasing means that involves a simplified support structure.

Yet an additional object of this invention is to furnish lateral support for an arrow positioned on a support rest without the necessity of providing a cushion plunger.

A still further objective of this invention is provided by an arrow rest with vertical and horizontal arrow support means that can be adjusted to accept different types of arrows.

The preceding and additional objects of the invention are provided by an arrow rest for an archery bow comprising two arrow support arms, each having a free end pivotal about a fixed end. The fixed ends of the arms are connected to structural means attachable to a bow by mounting means. The arrow rest has adjustable, enclosed spring means for biasing the support arms, the arms being respectively pivotal in vertical and horizontal arcs.

The preceding and still additional objectives of the invention are provided by an arrow rest for an archery bow having two support arms, each being provided with a free end pivotal in an arc about a fixed end. The fixed ends of the arms are attached to arrow rest structure comprising an elongated post member connected at right angles between the ends of an elongated cross bar member. The arrow rest is furnished with adjustable, enclosed spring means connected to each of the arms including a housing member containing a helical spring therein, one end of the spring being anchored to the housing, and the other end to the arm. One such housing member is adjustably connected to an end of the cross bar member, and another to the unconnected end of the post member. One arm of the arrow rest pivots vertically, while the other pivots horizontally, and limit means forming a part of the arrow rest define the arc through which the arms can pivot. Mounting means are also provided to attach the arrow rest to a bow.

The preceding and other objectives of the invention are provided by an archery bow having an arrow rest according to the preceding paragraph.

BRIEF DESCRIPTION OF THE DRAWINGS

The invention will be better understood when reference is had to the attached drawings, in which like-members refer to like-parts, and in which.

DETAILED DESCRIPTION OF THE INVENTION

Figure 1:
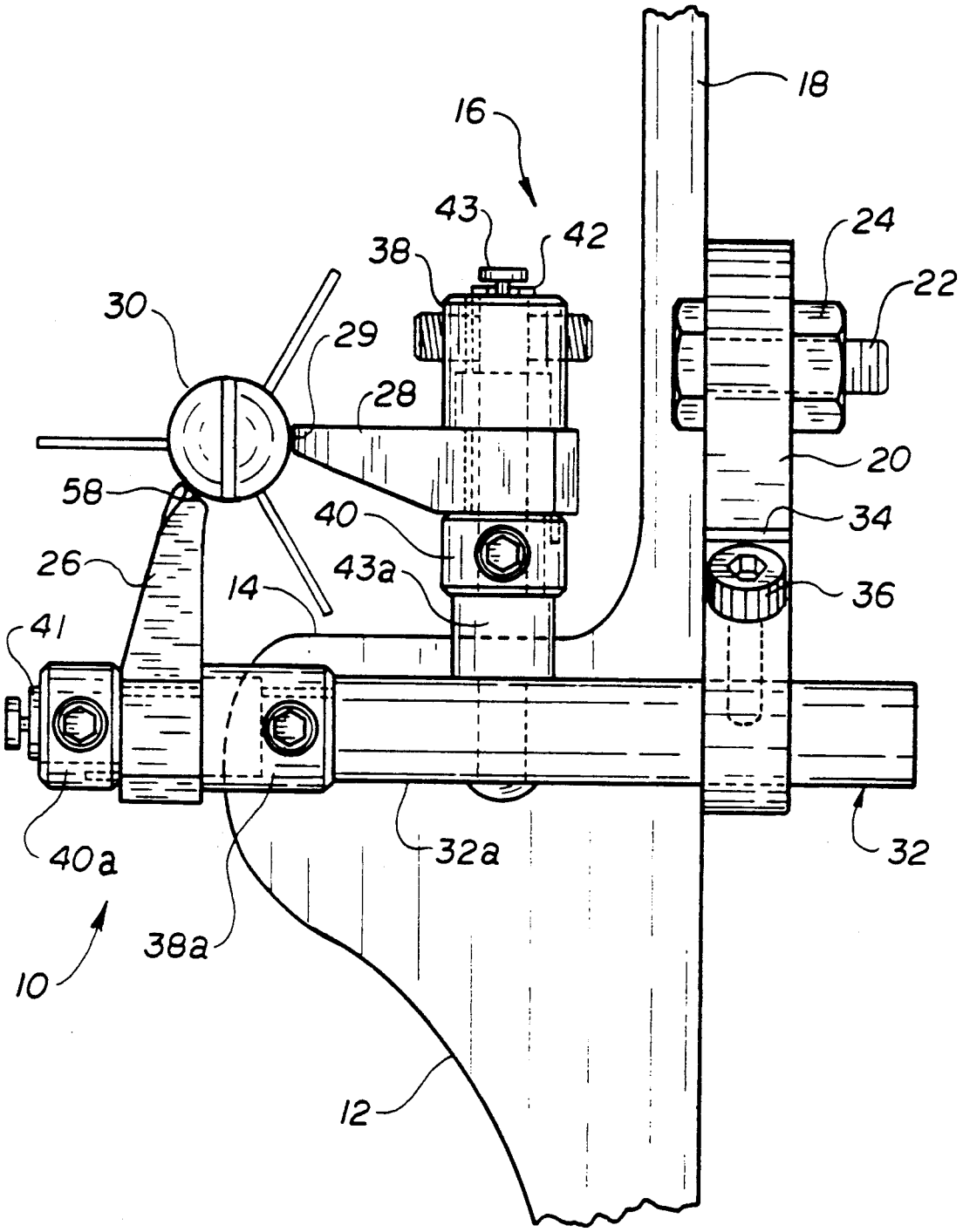
FIG. 1 is a rear elevation of an arrow rest of the invention mounted on a bow, supporting an arrow thereon.

FIG. 1 is a rear elevation of an arrow rest of the invention mounted on a bow, supporting an arrow.

As shown, the arrow rest is attached to the side wall riser 18 by means of a mounting bolt 22 which extends through both the side wall riser and a mounting bracket side plate 20, being secured by a mounting nut 24. The mounting bracket side plate 20 includes a split collar portion 34, enabling it to be securely connected to an elongated transverse cross bar 32, and to be held in that position by lock screw 36. The transverse cross bar 32 is positioned behind riser grip 12, and is fitted with an elongated vertical post 43, which rises above the bow shelf 14 into the window area of the bow 16. The vertical post 43 has a lateral support torque collar 38 adjustably connected to its upper end by set screws. The torque collar 38 has an enclosed spring therein which exerts a biasing torque on lateral support arm 28, as better seen in FIG. 3. The lateral support arm 28 is pivotally mounted on vertical post 43 between the lateral support arm torque collar 38 and a lateral support arm limit collar 40, the latter also being adjustably secured to vertical post 43 by means of set screws. The vertical post 43 extends through a hole extending through transverse cross bar 32, being held there by a peened end, while the limit collar 40 rests against an enlarged section **43*a* of the vertical post. Adjustably connected to the transverse cross bar 32 are components similar to those associated with the vertical post 43, comprising a vertical support arm torque collar 38*a*, a vertical support arm 26, and a vertical support arm limit collar 40*a*. The interaction of the cross bar components is similar to the components described in connection with the vertical post 43. The transverse cross bar 32 also includes a section of enlarged diameter 32*a*, and both the cross bar and the vertical post 43 have snap rings 41 attached to the ends thereof in order to retain the components during the course of their adjustment. Vertical support arm 26 has a canted end 58, which together with the angled end 29 of lateral support arm 28 serve to support an arrow 30 therebetween. During launch, the springs contained in vertical support arm torque collar 38*a* and lateral support arm torque collar 38** produce a biasing force which tends to dampen stress-imposed curvature of an arrow in both the vertical and horizontal planes, thereby stabilizing the flight of the arrow during launch.

The adjustment process of the arrow rest entails loosening lock screw 36 and adjusting the transverse positioning of cross bar 32 so that the support arms 26 and 28 are properly positioned in the window area 16 of the bow. After tightening the lock screw, the limit collars 40 and **40*a* are adjusted so that at one end of the arc formed by their permitted pivoting, support arms 26 and 28 are in the position illustrated, a position in which support of an arrow both vertically and laterally in the window of the bow is accomplished. The limit collars 40 and 40*a* are thereupon locked in position by tightening the set screws associated therewith. In a final procedure, the support arm torque collars 38 and 38*a*** are rotated until the proper amount of spring tension is obtained to provide the degree of support arm biasing desired. At that point, the torque collars are secured in position by tightening the set screws associated therewith.

Figure 2:
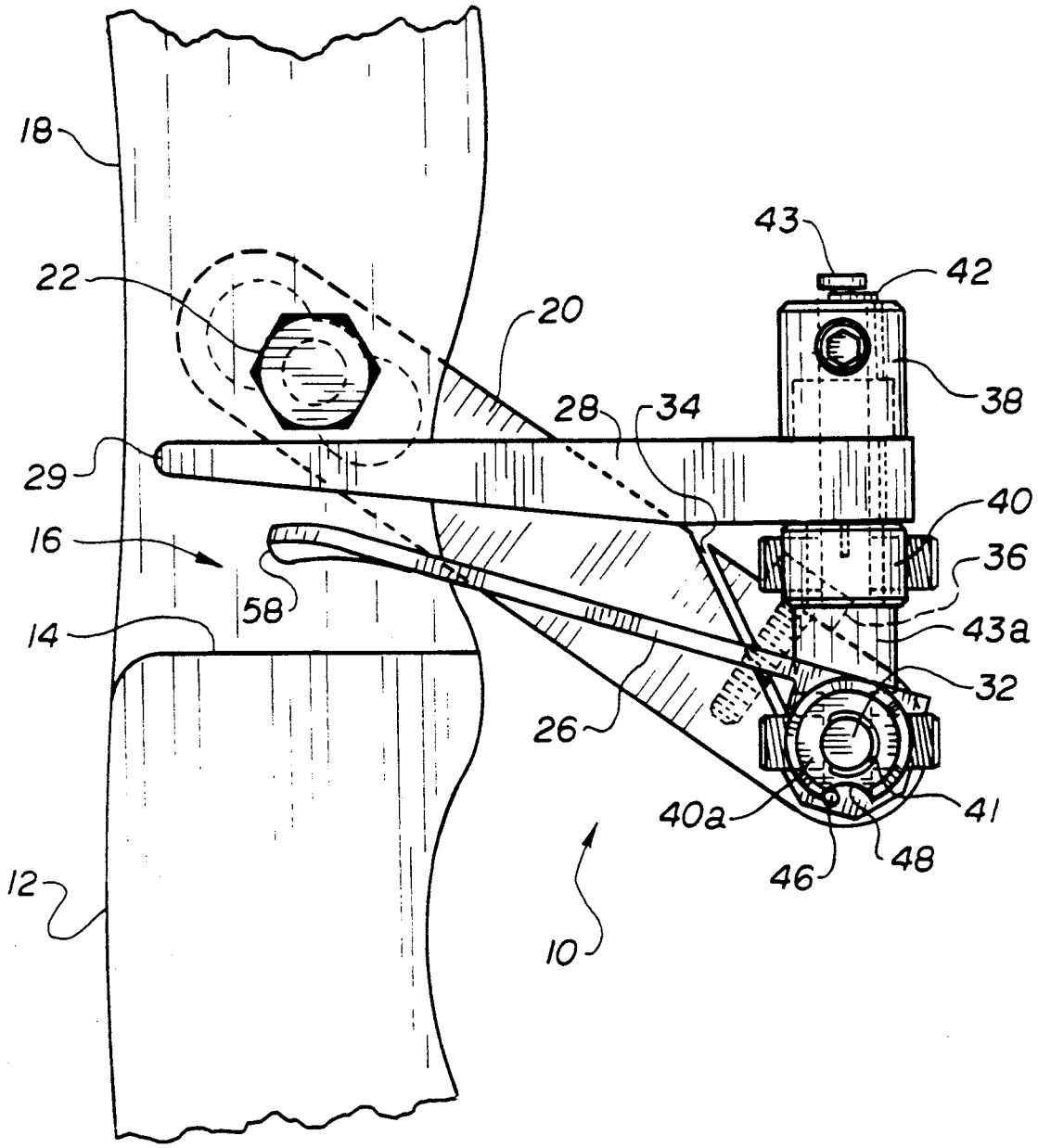
FIG. 2 is a left side elevation of the arrow rest of FIG. 1.

FIG. 2 is a left side elevation of the arrow rest of FIG. 1. The arrow rest, generally 10 is attached to the side wall riser 18 by mounting bolt 22, which extends through mounting bracket side plate 20, a position in which it is secured by a mounting nut, not shown. The side plate 20 is fastened to transverse cross bar 32 by means of a split collar portion 34, and secured in its desired position by lock screw 36. Vertical post 43 rises at right angles from transverse cross bar 32 and has mounted thereon lateral support arm torque collar 38, a lateral support arm 28, and a lateral support arm limit collar 40. The vertical post is held to the transverse cross bar by extending therethrough and being secured by means of a peened end, an enlarged spacer portion **43*a* of the vertical post being located between the transverse cross bar 32 and lateral support arm limit collar 40**.

The transverse cross bar 32 has positioned thereon vertical support arm 26, possessing a canted end 58. Pivoting of support arm 26 is controlled by a limit pin 46 extending from the arm, which is received into a limit groove 48 of lateral support arm limit collar **40*a*, the travel arc of the pin being thereby controlled. Snap ring 41 is secured about the end of transverse cross bar 32, serving the purpose previously described. The canted end 58 and angled end 29, respectively, of support arms 26 and 28 are adjusted to provide support for an arrow, not shown, positioned above the shelf 14 in the window area 16** of the bow.

While dimension of the arrow rest components can vary, and will depend upon the dimensions of the bow and the arrows used therewith, commonly, the transverse cross bar will have a length of about 3" while the vertical post will have a length of about 1¼". The mounting bracket will conveniently be about 2½", and the support arms will have a length of about 2".

Figure 3:
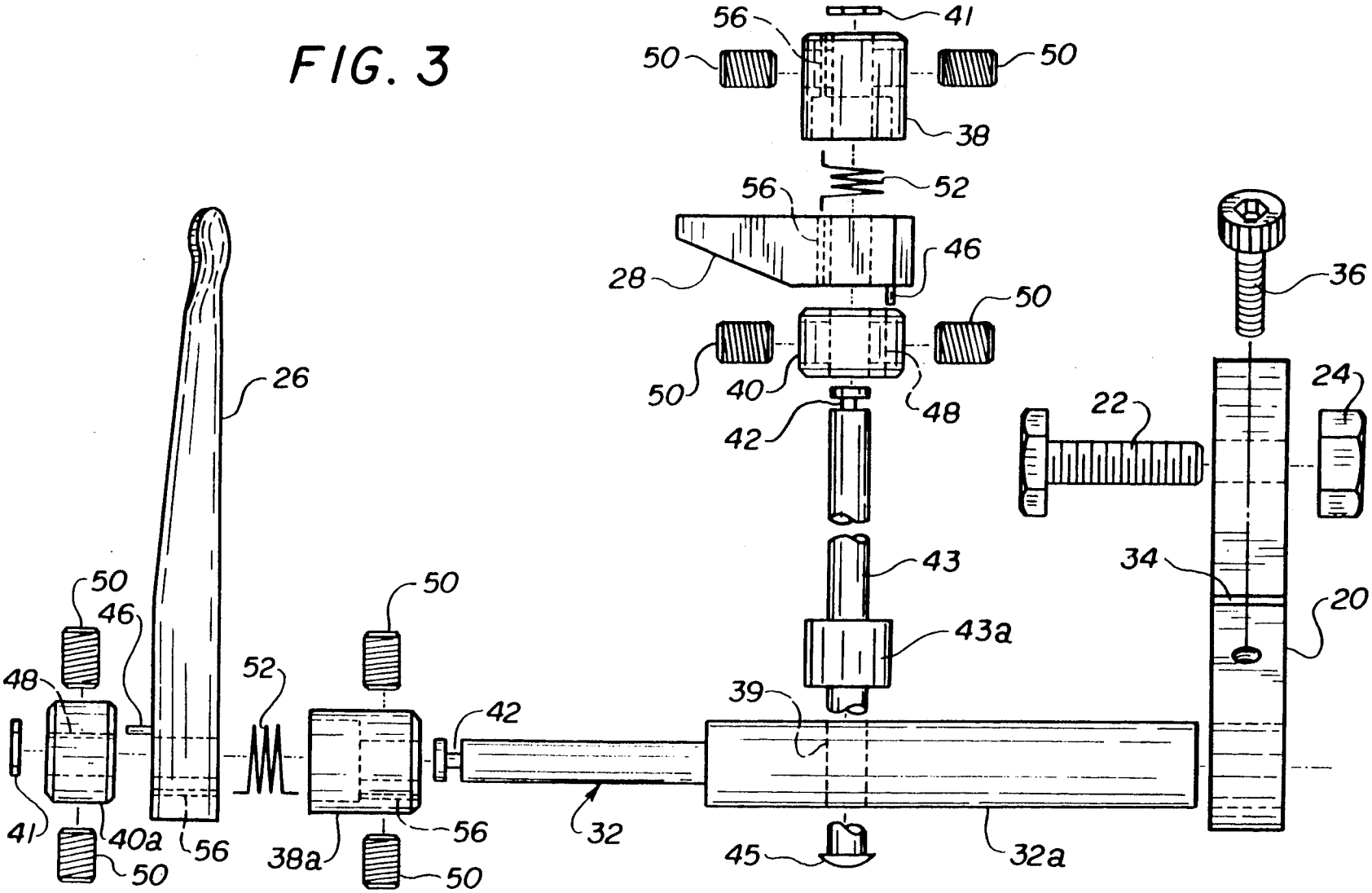
FIG. 3 is an exploded view of an arrow rest of the invention.

FIG. 3 is an exploded view of an arrow rest of the invention. The Figure shows details of the transverse cross bar 32, with its enlarged portion **32*a*, and including snap ring groove 42. The cross 22 bar is adapted to receive vertical support arm torque collar 38*a* thereon, which is fastened in position by said screws 50. One end of a spring member 52 is received in a spring anchor hole 56 contained within the hollow interior of the collar, while the other end of the spring is received in spring anchor hole 56, located in vertical support arm 26, also fitted onto the cross bar 32. The vertical support arm 26 has a limit pin 46 extending therefrom which is received into a limit groove 48, located in vertical support arm limit collar 40***a*, also is received on transverse cross bar 32. The cross bar assembly is completed by snap ring 41, adapted for fastening in snap ring groove 42.

Extending vertically at right angles from the transverse cross bar 32 is vertical post 43, which is provided with an enlarged section 43*a* and a snap ring groove 42. The lower end of the vertical post extends through a hole 39 in the cross bar 32, and is held in that position by the peening of its end 45.

Mounted on the vertical post is a lateral support arm limit collar 40, secured in position with set screws 50. Also positioned on the vertical post is lateral support arm 28, the limit pin 46 extending therefrom and being received in limit groove 48 of the limit collar 40. One end of the spring 52 is received into spring anchor hole 56 of lateral support arm 28, while the other end of the spring is positioned in spring anchor hole 56 located in lateral support arm torque collar 38, which is also mounted on the vertical post 43, being held in position by said screws 50. Finally, a snap ring 41 is positioned about snap ring groove 42 for reasons previously indicated.

A mounting bracket side plate 20 is fitted over the enlarged end 32*a* of the transverse cross bar 32, being held in that position by means of a split collar portion 34 which is secured about the cross bar by means of a lock screw 36. The mounting bracket side plate 20 is connected to a bow by means of mounting bolt 22 extending therethrough, and locked into position by means of mounting nut 24.

The positioning of springs 52 within the confines of the support arm torque collars is of considerable advantage, since it permits the springs to retain their lubrication and eliminates contamination of the springs by dirt and debris which would otherwise interfere with the maintenance of the torque provided by the spring.

Figure 3A:
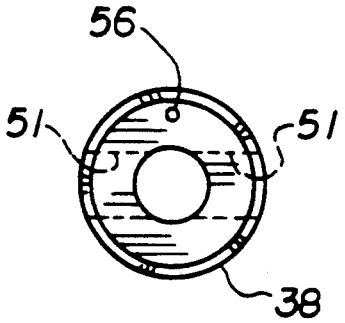
FIG. 3A is a front elevation of a support arm torque collar of the invention.

FIG. 3A is a front elevation of a support arm torque collar 38 of the invention, illustrating set screw holes 51 and the spring anchor hole 56. While one set screw would serve to attach the various adjustable components described in the preceding securely to the cross bar and vertical posts, respectively, the provision of two set screws is often desirable, since it results in a more secure connection.

Figure 3B:
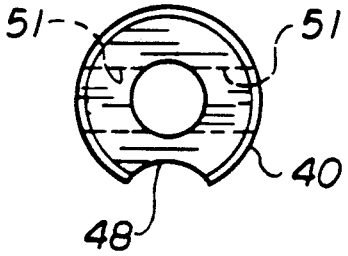
FIG. 3B is a front elevation of a support arm limit collar of the invention.

FIG. 3B is a front elevation of a support arm limit collar 40 of the invention showing the limit groove 48 located therein and the set screw holes 51 provided to attach the collar to the transverse cross bar or vertical post members, as the case may be.

While various metals can be used to fabricate the various components of the arrow rest contemplated by the invention, metals such as aluminum or magnesium, particularly aluminum are preferred, since they resist corrosion and are lightweight.

Figure 3C:
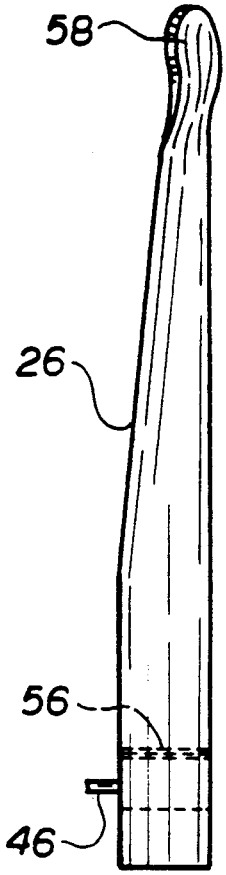
FIG. 3C is a top plan view of a vertical support arm of the invention.

FIG. 3C is a top plan view of a vertical support arm 26 of the invention, showing its canted end 58. The Figure also illustrates the spring anchor hole 56 extending into the arm and the limit pin 46 projecting therefrom. The canted end 58 is provided in order to force the supported arrow towards the lateral support arm 28, thereby preventing the arrow from becoming inadvertently dislodged from the arrow rest support.

Figure 3D:
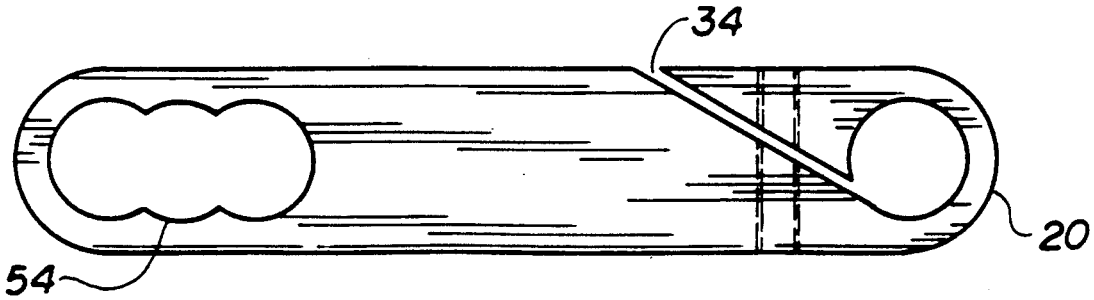
FIG. 3D is a side elevation of a mounting bracket side plate of the invention.

FIG. 3D is a side elevation of a mounting bracket side plate 20 of the invention. As shown, the side plate is provided with three contiguous mounting holes 54, allowing the side plate to position the attached cross bar 32 at varying distances from the bow. While a split collar portion 34 is illustrated as the means for attaching the side plate to the transverse cross bar 32 since it provides an exceptionally secure point of attachment, alternative means such as, for example, set screws, could also be employed.

While in accordance with the patent statutes, a preferred embodiment and best mode has been presented, the scopc of the invention is not limited thereto, but rather is measured by the scope of the attached claims.

What is claimed is:

1. An arrow rest for an archery bow, said arrow rest comprising:

first arm means having a free end and a fixed end, and being pivotable through an arc in one plane about said fixed end of said first arm means;

a first helical spring for biasing said first arm means to a rest position, for dampening stress imposed by curvature of an arrow to stabilize the flight of the arrow during launch;

second arm means having a free end and a fixed end, and being pivotable through an arc in a second plane about said fixed end of said second arm means, said second plane being transverse to said one plane, and said first and second arm means supporting an arrow being launched from the bow;

mounting means for mounting said first arm means and said second arm means to the bow; and adjusting means for adjusting a biasing torque exerted by said first helical spring wherein said adjusting means is rotated to adjust said biasing torque.

2. An arrow rest according to claim 1 and further comprising:

a second helical spring for biasing said second arm means to a rest position, for dampening stress imposed by curvature of an arrow to stabilize the flight of the arrow during launch.

3. An arrow rest according to claim 1 wherein said adjusting means comprises a torque adjusting collar.

4. Apparatus according to claim 1 wherein said arrow rest comprises structural means connected to said mounting means, to which the fixed end of said first arm means being connected to said structural means.

5. An arrow rest according to claim 4 wherein said adjusting means comprises:

a housing member adjustably connected to said structural means adjacent said first arm means;

means for limiting said arc through which said first arm pivots;

wherein said first helical spring is within said housing member, one end of said spring being connected to said housing member, and the other end to said first arm means for imposing torque on said first arm means; and wherein said housing member can be adjusted to increase or decrease the force in said spring and consequently, the torque imposed on said first arm means.

6. An arrow rest according to claim 5 and further comprising at least one set screw for adjustably connecting said housing member to said structural means.

7. An arrow rest according to claim 5 wherein said limiting means comprises first engagement means connected to said first arm means, and a collar means connectable to said structural means and being provided with second engagement means for engaging and limiting the travel of said first engagement means.

8. An arrow rest according to claim 7 wherein said first engagement means are pin means and second engagement means are notch means.

9. An arrow rest according to claim 8 and further including at least one set screw and means in said collar means for receiving said set screw to connect said collar means to said structural means.

10. An arrow rest according to claim 4 wherein said structural means comprises a bar member having first and second ends, and a post member connected between the ends of said bar member at right angles to said bar member, said first arm means being connected to one end of said bar member, and said second arm means being connected to said post member.

11. An arrow rest according to claim 10 wherein said bar member is an elongate cross bar member extending horizontally when the bow is vertical, and said post member comprises an elongate post member.

12. An arrow rest according to claim 10 wherein said mounting means comprises a bracket attachable to said bar member, and to said bow.

13. An arrow rest according to claim 12 in which said bar member includes collar means and a split collar portion for attaching said collar means to said structural means.

14. An arrow rest according to claim 1 and further including enclosing means for enclosing said first helical spring.

15. An arrow rest according to claim 2 and further including second adjusting means for adjusting the biasing torque exerted by said second helical spring.

16. An arrow rest according to claim 2 and further including second enclosing means for enclosing said second helical spring.

17. An arrow rest according to claim 1 wherein said one plane is vertical and said second plane is horizontal when the bow is vertical.

18. An arrow rest according to claim 17 in which the free ends of said first and second arm means in contact with arrows are substantially flat, and the end of said first arm vertically pivotable is canted toward said second arm means.

* * * * *